United States Patent [19]

Limburg et al.

[11] 3,930,858

[45] Jan. 6, 1976

[54] HEAT DEVELOPMENT PROCESS UTILIZING A PHOTOSENSITIVE COMPOSITION CONTAINING A HALOGENATED POLYMER AND A STRONG ORGANIC ELECTRON ACCEPTOR

[75] Inventors: William W. Limburg, Penfield; Leon A. Teuscher, Webster, both of N.Y.

[73] Assignee: Xerox Corporation, Stamford, Conn.

[22] Filed: Nov. 1, 1973

[21] Appl. No.: 411,628

[52] U.S. Cl. ..... 96/48 HD; 96/27 E; 96/90 R; 96/115 P

[51] Int. Cl.[2] ..... G03C 5/24

[58] Field of Search ..... 96/48 R, 48 HD, 115 R, 96/90 R, 27 E

[56] References Cited

UNITED STATES PATENTS

| | | | |
|---|---|---|---|
| 2,772,158 | 11/1956 | Elliott | 96/48 R |
| 2,789,052 | 4/1957 | Elliott | 96/48 R |
| 2,789,053 | 4/1957 | Elliott | 96/48 R |
| 2,905,555 | 9/1959 | Fuchsman et al. | 96/48 R |
| 3,046,137 | 7/1962 | Ogden | 96/48 R |

OTHER PUBLICATIONS

Kotov, et al.: In Doklady An SSSR, Vol. 159, pp. 640–643.

Owen, et al.: Journal of Polymer Science, Vol. 10, (113–122, 1972).

*Primary Examiner*—Won H. Louie, Jr.

*Attorney, Agent, or Firm*—James J. Ralebate; James P. O'Sullivan; Jerome L. Jeffers

[57] ABSTRACT

Disclosed is a method for forming a visible image. The method involves exposing in an imagewise manner a mixture of a halogenated polymer having halogen atoms on alternating carbon atoms and a strong organic electron acceptor to actinic radiation to induce dehydrohalogenation of the polymer. The exposed composition is then subjected to heat in order to provide a visible image.

13 Claims, No Drawings

HEAT DEVELOPMENT PROCESS UTILIZING A PHOTOSENSITIVE COMPOSITION CONTAINING A HALOGENATED POLYMER AND A STRONG ORGANIC ELECTRON ACCEPTOR

BACKGROUND OF THE INVENTION

Straight chain polymeric molecules containing chlorine and hydrogen on alternating carbon atoms are known to dehydrohalogenate when exposed to ultraviolet light. This process begins with the generation of free radicals on the molecule with the subsequent formation of polyenes which absorb visible light. The use of this system for imaging is of only limited value since it requires extensive radiation to cause appreciable dehydrohalogenation. In order to provide a feasible photoimaging process, the above-described process must be accelerated so that the image is formed in a reasonable period of time upon irradiation.

Adding chemical components to the halogen containing polymer increases the rate of dehydrohalogenation. Owen and Bailey disclose in the Journal of Polymer Science, Vol. 10, (113–122, 1972) that benzophenone will photosensitize the degradation of polyvinyl chloride. This reference states that among the most important characteristics of benzophenone is its ability to abstract a hydrogen atom from a donor. It has also been proposed that a Friedel-Crafts catalyst be used to promote the dehydrohalogenation; however, this type of inorganic catalyst is not readily combinable with the organic polymer. A series of patents, i.e. U.S. Pat. Nos. 2,772,158; 2,789,052 and 2,789,053, disclose the use of Friedel-Crafts type catalyst progenitors, which are more compatible with the polymer, to solve this problem. Of course, such a system requires the inclusion of at least two separate species to form the Friedel-Crafts type catalyst in situ with the consequent increased difficulty in formulation inherent in such a two component system. In addition, the Friedel-Crafts progenitors proposed, e.g. aluminum stearate, tend to cloud the composition and provide, at best, films which are translucent.

It is disclosed by Kotov et al, In Doklady AN SSSR, Vol. 159, pp. 640–643 that polyvinyl chloride in combination with an electron acceptor such as chloranil will become colored upon irradiation with ionizing radiation, e.g. gamma or beta radiation, from 77°–133°K. However, this reference also discloses that the addition of acceptor impurities inhibits the coloring of the thawed polymer upon irradiation.

It is disclosed by Loan in Polymer Preprints, Vol. II, No. I, page 224, 1970, that tetracyanoethylene increases the rate of thermal dehydrochlorination of polyvinyl chloride with subsequent blackening of the polymer. These experiments were carried out at ca. 160°C. and would not be suggestive of an imaging process due to the generalized nature of the darkening.

It would be desirable, and it is an object of the present invention, to provide a novel high gain imaging system.

It is another object to provide such a system which is based upon the dehydrohalogenation of a chlorine, bromine, or iodine containing polymer.

A further object is to provide such a system which is not hindered by free radical quenching as is the case with systems employing benzophenone as the dehydrohalogenation promotor.

An additional object is to provide a system which rapidly dehydrohalogenates upon exposure to actinic radiation.

SUMMARY OF THE INVENTION

The present invention is a method for the formation of a photographic image. The method involves:

a. exposing to actinic radiation in an imagewise manner a composition consisting essentially of:

1. a polymeric molecule containing units characterized by the formula:

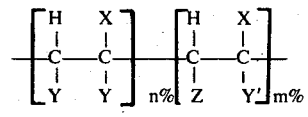

wherein X is chlorine, bromine or iodine; Y and Y′ are X or hydrogen and Z is Y or an alkyl, aryl or alkaryl constituent containing from 1 to 8 carbon atoms, and *n* and *m* are integers from 0 to 100; and 2. a strong organic electron acceptor; and b. heating the so-exposed composition to a temperature and for a time sufficient to form a visible image in the exposed areas without causing image formation in the non-exposed areas.

DETAILED DESCRIPTION

Polymers useful in the present invention are those which contain units of the formula:

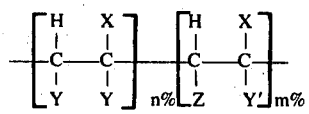

In the above formula, X is chlorine, bromine or iodine; Y and Y′ are X or hydrogen, and Z is Y or an alkyl, aryl or alkaryl constituent containing from 1 to 8 carbon atoms.

The symbols *n* and *m* represent numbers which designate the relative mole percent composition of the individual units in the polymer and can vary from 0 to 100 with the sum of *n* percent and *m* percent being 100. Thus, when Y is hydrogen and *n* is 100, the formula depicts a polyvinyl halide, e.g. polyvinyl chloride, when X is chlorine. When Y′ is X, Z is H and *m* is 100, a polyvinylidene halide is depicted. When Y and Y′ are as defined above, and *n* and *m* are numbers between 0 and 100 percent, a copolymer of a vinyl halide and a vinylidene halide is depicted. The polymers useful in the instant invention can also be substituted with organic constituents such as when Z is an alkyl, aryl or alkaryl radical. Examples or organic constituents which Z represents include methyl, ethyl, propyl, butyl, octyl, phenyl, substituted phenyl, methyl phenyl and ethyl phenyl. Corresponding to the above formula, any polymer containing chlorine, bromine or iodine which will dehydrohalogenate to provide at least 2 conjugated double bonds per molecule may be used. In addition to the above-described polymers, the chlorinated rubber known as Parlon can be used in the instant process. The halogen containing unit can be copolymerized with other monomeric units such as vinyl acetate, ethylene, propylene, methyl acrylate, ethyl acrylate, methyl methacrylate, ethyl methacrylate, styrene, α-methyl styrene, ring substituted styrenes and acrylonitrile.

Suitable electron acceptors are those organic compositions which have $\pi$ electron systems which are either on or conjugated with 2 or 3, preferably 4, electron withdrawing groups. Electron withdrawing groups which are suitable for this purpose include, for example, cyano (CN), nitro ($NO_2$), chloro (Cl), bromo (Br) and trifluoromethyl ($-CF_3$).

Specific examples of organic electron acceptors useful in the present invention include tetracyanoethylene, dichloro dicyano benzoquinone, cyanil, chloranil, bromonil, tetracyanoquinodimethan, and 2,4,7 trinitrofluoronone. These electron acceptors, which do not function as photosensitizers or hydrogen abstractors, are readily compatible at levels required for the instant process with the halogenated polymers previously described. Furthermore, they provide stable compositions when admixed with the polymer in that the polymer in admixture with the electron acceptor will not readily dehydrohalogenate in the absence of actinic radiation.

The electron acceptor is usually added to the polymer in a small but effective amount. As used herein, an effective amount is that which will increase the rate of dehydrohalogenation of the polymer to a noticeable extent. This amount will vary with the polymer, electron acceptor, wavelength of radiation and temperature but will be readily apparent to the art skilled with only routine experimentation. Typically, the electron acceptor will comprise at least about 0.01 weight percent of the polymer with an amount within the range from 0.05 to 5 weight percent being preferred. Larger amounts can be used, but normally would not be for economic reasons. Additionally, at higher concentrations of the acceptor, phase separation may occur. The composition can contain components other than the polymer and electron acceptor so long as these materials do not significantly interfere with the dehydrohalogenation of the polymer. Thus, it would be necessary to remove stabilizers from the polymer prior to casting the film, only if the stabilizers were of the type which would interfere with dehydrohalogenation in the environment of the film being irradiated.

The halogenated polymer and electron acceptor are prepared for use by mixing in a suitable solvent, casting the so-formed solution on a suitable substrate and evaporating the solvent. Suitable solvents are those liquid compositions which dissolve both the polymer and electron acceptor. Useful solvents include tetrahydrofuran (THF), acetone, carbon disulfide and methyl ethyl acetone. Exemplary of substrates upon which the solution may be cast are mylar, glass, metals, and coated papers. After casting the solution on a suitable substrate, the solvent is evaporated either at room temperature or slightly elevated temperatures.

At this point, the composition is ready for imaging which is accomplished by subjecting it to actinic radiation in an imagewise fashion, i.e. irradiating the film in those areas in which the image is desired. This is normally done by laying a stencil or negative having both areas which are opaque and transparent to the radiation over the film and directing the radiation through this layer to the film.

Actinic radiation, as used herein, as intended to refer to electromagnetic radiation having wavelengths greater than 200 nm with sufficient energy to promote dehydrohalogenation of the polymer. The wavelengths will vary depending on the absorption maximum of the polymer being used. For example, polyvinylidene chloride, polyvinyl bromide and polyvinyl iodide will dehydrohalogenate upon exposure to longer wavelengths than will polyvinyl chloride. The wavelengths at which various polymers dehydrohalogenate are either well-known or can be readily determined by those skilled in the art. Normally, the radiation will be in the ultraviolet range with wavelengths of 200 to 350 nm being typical.

After irradiation, the film is heated to develop the image. The heating step is necessary to enhance the dehydrohalogenation initiated by irradiation. The heating is carried out at a temperature and for a time sufficient to produce the desired image. The time and temperature will depend on the specific composition being imaged as well as the intensity and duration of irradiation. In addition, time and temperature will vary with each other in an inverse relationship. Typical temperatures are from room temperature to 150°C. with a temperature in the range of from 80° to 125°C. being preferred. Image formation will normally be complete in about 0.5 to 1.5 minutes at temperatures within the preferred range. During heating, care should be taken not to raise the temperature to a level at which the background, i.e. non-exposed areas, will thermally dehydrohalogenate.

Dehydrohalogenation should be carried out to a point at which the resulting polyene contains at least about 7 conjugated double bonds per molecule in order to provide a visible image using ordinary light. When fewer than about 7 conjugated double bonds are formed, ultraviolet readout is necessary. While the invention is not predicated to any particular theory and should not be limited thereto, it is believed to operate in the following manner, wherein, for illustration, the polymer is polyvinyl chloride and the electron acceptor is tetracyanoethylene (TCNE).

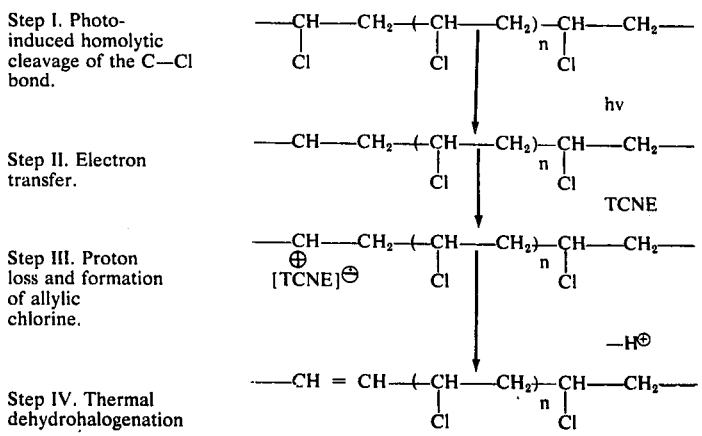

and polyene formation (gain greater than one based on absorbed radiation).

-continued

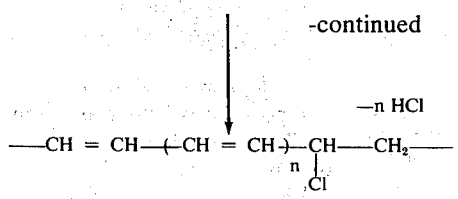

The method of practicing the present invention is further illustrated by the following examples in which all percentages are by weight unless otherwise specified.

EXAMPLE I

Reprecipitated and inhibitor free polyvinyl chloride (PVC) 99 percent in tetrahydrofuran (THF) is mixed with 1 percent tetracyanoethylene (TCNE) and coated on a microscope slide. A control of PVC without TCNE is similarly prepared. Both samples are irradiated with a short wavelength 10 watt input ultraviolet "mineral light" produced by Ultraviolet Products, Inc., San Gabriel, California, for 10 minutes at which time examination of each sample indicates no visible change.

Both control and test sample are heated to a temperature of 120°C. by means of a heat gun for 5 minutes after which time a visible image is detected in the TCNE treated sample which turned light brown in the exposed area while no visible change is observed in the control.

Both the control and imaged sample were allowed to stand at room temperature in the presence of daylight and fluorescent lighting for 12 months and found to be stable over this period.

EXAMPLE II

A copolymer of vinyl chloride and vinylidene chloride (sold by the Dow Chemical Company of Midland, Mich., as Saran 130) is precipitated from THF by methanol to remove its stabilizer.

The Saran 130 is then mixed with 1 percent TCNE and cast into a film from its 10 percent solution in THF. The film is exposed to UV light and heated with a heat gun as in Example I. An image appears upon heating which has color intensity greater than that observed in the TCNE sensitized polymer of Example I.

EXAMPLE III

A polyvinyl chloride solution is prepared as in Example I except that chloranil is used as the electron acceptor at the 2 weight percent level. The solution is cast upon the substrate and the solvent evaporated. The film is irradiated as previously described for a 20 second period. The resulting image is good; however, a green color is observed upon heat development.

EXAMPLE IV

The procedure of Example I is repeated except that the electron acceptor is tetracyanoquinodimethan (TCNQ) at the 2 wt. percent level. The films image well; however, heat development is difficult due to the reactivity of TCNQ and PVC.

EXAMPLE V

Samples of PVX where X is chlorine or bromine are dissolved in tetrahydrofuran to provide 10 percent solutions. To these solutions is added TCNE at the 2 percent level. The solutions are then cast upon microscope slides to provide thin films which are irradiated for 15 minutes with the UV light source described in Example I. A dark brown-black image is observed on the PVB coated slide without heating it above room temperature. A significantly less intense image is observed upon heating the PVC coated slide.

Irradiation of the PVB coated slide for 15 seconds requires heat development before a visible image is observed; thus, confirming the inverse relationship of irradiation time with heat development time. Irradiation of PVB and PVC containing no TCNE gives no visible image upon 15 minutes of irradiation even with subsequent heating.

EXAMPLE VI

Films of polyvinyl chloride containing TCNE, benzophenone, and a mixture of TCNE and benzophenone are prepared as in Example I. Each PVC film contains an equimolar amount of each additive (2.56 percent TCNE and 3.64 percent benzophenone).

The films containing benzophenone and a mixture of benzophenone and TCNE do not form visible images upon irradiation for 15 minutes and subsequent heating. Under similar circumstances, the PVC film containing only TCNE forms a visible image.

What is claimed is:

1. A method of forming an image which comprises:

a. exposing to actinic radiation in an imagewise manner a composition consisting essentially of:

1. a polymeric molecule containing a number of units characterized by the formula:

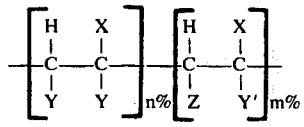

wherein X is chlorine, bromine, or iodine, Y and Y′ are X or hydrogen and Z is Y or an alkyl, aryl or alkaryl constituent containing from 1 to 8 carbon atoms, and *n* percent and *m* percent are numbers from 0 to 100 representing the relative mole percent composition of the individual units in the polymer, sufficient to provide at least 2 conjugated double bonds upon dehydrohalogenation; and 2. a strong organic electron acceptor which is a composition having $\pi$ electron systems either on or conjugated with 2, 3 or 4 electron withdrawing groups selected from the group of cyano (CN), nitro ($NO_2$), chloro (Cl), bromo (Br) and trifluoromethyl ($—CF_3$); and b. heating the so-exposed composition to a temperature and for a time sufficient to form a visible image in the exposed areas without causing image formation in the non-exposed areas.

2. The method of claim 1 wherein Y is hydrogen and *n* percent is 100 and *m* percent is 0.

3. The method of claim 2 wherein X is chlorine.

4. The method of claim 2 wherein X is bromine.

5. The method of claim 1 wherein Y′ is X, Z is H, *m* percent is 100 and *n* percent is 0.

6. The method of claim 5, wherein X is chlorine.

7. The method of claim 1, wherein Y is hydrogen, Y′ is X, Z is H and *n* percent and *m* percent are integers between 0 and 100.

8. The method of claim 7, wherein X is chlorine.

9. The method of claim 1, wherein the electron acceptor is present in an amount of from 0.05 to 5 weight percent of the polymer.

10. The method of claim 1, wherein the radiation is ultraviolet light having a wavelength of from 200 to 350 nm.

11. The method of claim 1, wherein the exposed composition is heated to a temperature up to 150°C.

12. The method of claim 11, wherein the temperature is from 80° to 125°C.

13. The method of claim 1 wherein the electron acceptor is tetracyanoethylene, dichloro dicyano benzoquinone, cyanil, chloranil, bromonil, tetracyanoquinodimethan or 2,4,7-trinitrofluorenone.

* * * * *